US010738648B2

(12) United States Patent
Valencia

(10) Patent No.: US 10,738,648 B2
(45) Date of Patent: Aug. 11, 2020

(54) GRAPHENE DISCS AND BORES AND METHODS OF PREPARING THE SAME

(71) Applicant: General Electric Company, Schenectady, NY (US)

(72) Inventor: Antonio Guijarro Valencia, Munich (DE)

(73) Assignee: General Electric Company, Schenectady, NY (US)

( * ) Notice: Subject to any disclaimer, the term of this patent is extended or adjusted under 35 U.S.C. 154(b) by 561 days.

(21) Appl. No.: 15/292,179

(22) Filed: Oct. 13, 2016

(65) Prior Publication Data

US 2018/0106162 A1 Apr. 19, 2018

(51) Int. Cl.

| | |
|---|---|
| ***F01D 5/02*** | (2006.01) |
| ***F01D 25/00*** | (2006.01) |
| ***F01D 5/12*** | (2006.01) |
| ***F01D 5/30*** | (2006.01) |
| ***F01D 5/28*** | (2006.01) |
| ***B21J 1/00*** | (2006.01) |
| ***B21K 1/32*** | (2006.01) |

(52) U.S. Cl.

CPC ..... *F01D 25/005* (2013.01); *B21J 1/003* (2013.01); *B21K 1/32* (2013.01); *F01D 5/02* (2013.01); *F01D 5/12* (2013.01); *F01D 5/288* (2013.01); *F01D 5/3092* (2013.01); *F05D 2220/32* (2013.01); *F05D 2230/25* (2013.01); *F05D 2230/50* (2013.01); *F05D 2230/90* (2013.01); *F05D 2240/60* (2013.01); *F05D 2260/95* (2013.01); *F05D 2300/224* (2013.01); *F05D 2300/5024* (2013.01); *F05D 2300/6032* (2013.01)

(58) Field of Classification Search

CPC ..... F01D 5/08; F01D 25/007; F05D 2260/95; F05D 2260/231; F05D 2230/90

See application file for complete search history.

(56) References Cited

U.S. PATENT DOCUMENTS

| | | | | |
|---|---|---|---|---|
| 9,067,674 | B2 | 6/2015 | Nordin et al. | |
| 9,105,284 | B2 * | 8/2015 | Winarski | G11B 7/2548 |
| 9,418,770 | B2 * | 8/2016 | Veerasamy | C30B 29/02 |
| 9,666,466 | B2 * | 5/2017 | Parkhe | H01L 21/67103 |
| 9,786,539 | B2 * | 10/2017 | Wang | H01L 21/6833 |
| 2014/0112797 | A1 | 4/2014 | Haje | |
| 2015/0198056 | A1 * | 7/2015 | Amini | C08K 3/04 415/173.4 |
| 2015/0330464 | A1 * | 11/2015 | Kang | B61H 5/00 188/218 XL |
| 2015/0345504 | A1 | 12/2015 | Kadau et al. | |
| 2016/0068266 | A1 | 3/2016 | Carroll | |
| 2016/0083621 | A1 | 3/2016 | Schmidt | |
| 2016/0083666 | A1 | 3/2016 | Rahoui et al. | |
| 2016/0102611 | A1 | 4/2016 | Snyder | |
| 2016/0370133 | A1 * | 12/2016 | Liu | F28F 21/081 |

* cited by examiner

*Primary Examiner* — Ninh H. Nugyen

(74) *Attorney, Agent, or Firm* — Dority & Manning, P.A.

(57) ABSTRACT

Provided are discs and bores of a gas turbine engine having one or more graphene layers and methods of preparing the same. The one or more graphene layers are disposed adjacent to the disc rim and/or bore to improve heat transfer and reduce oxidation of the discs. Methods of preparing the graphene layers and systems for using the same are provided.

16 Claims, 4 Drawing Sheets

GRAPHENE DISCS AND BORES AND METHODS OF PREPARING THE SAME

FIELD OF THE INVENTION

Embodiments described herein generally relate to disc and bores in a gas turbine engine and methods of preparing the same.

BACKGROUND OF THE INVENTION

The turbine section of a gas turbine engine contains a rotor shaft and one or more turbine stages, each having a turbine disc (or rotor) mounted or otherwise carried by the shaft and turbine blades mounted to and radially extending from the periphery of the disc. A turbine assembly typically generates rotating shaft power by expanding hot compressed gas produced by the combustion of a fuel. Gas turbine buckets or blades generally have an airfoil shape designed to convert the thermal and kinetic energy of the flow path gases into mechanical rotation of the rotor.

Turbine discs are exposed to very high temperatures at the disc post or rim (where blades are attached) due to contact with the hot compressed gas and are exposed to low temperatures at the bores (where the disc is carried by the shaft). The variation of temperatures across the discs is referred to as the rim-to-bore temperature gradient. Conventional coatings for discs reduce the life of the discs as the rim-to-bore gradient increases due to isolation created by the coating. Unless the coating is metallic, which adds weight to the disc or creates galvanic pairs, conventional coatings for discs do not directly conduct heat but prevent heat conduction. Discs are thus typically uncoated and have a lifetime limited by the rim-to-bore temperature gradient. The surrounding temperatures and traces of hot gas ingestion from imperfect purging also reduce the life of the discs by reducing the disc's damage tolerance.

Accordingly, there remains a need for an improved design for discs and methods of making such discs to reduce rim-to-bore gradients and improve the lifetime of the discs.

BRIEF DESCRIPTION OF THE INVENTION

Aspects and advantages of the invention will be set forth in part in the following description, or may be obvious from the description, or may be learned through practice of the invention.

A disc is generally provided comprising a disc defining an outer surface, wherein the disc comprises a base material, and one or more graphene layers disposed along the outer surface, along a bore in the disc, embedded in the base material, or combinations thereof. In some embodiments, one or more of the graphene layers is doped and in some embodiments, one or more of the graphene layers is doped with boron, nitrogen, or combinations thereof. In certain embodiments, the disc comprises at least ten monoatomic graphene layers disposed along the outer surface, along the bore, embedded in the base material, or combinations thereof. The base material of the disc, in some embodiments, comprises a nickel superalloy, and in some embodiments, one or more graphene layers are embedded in the base material.

In certain embodiments, the disc comprises an outer surface where the outer surface comprises a front surface, a back surface, and a disc rim, wherein the disc rim is perpendicular to the front and back surfaces and is defined by the circumference of the disc. In some embodiments, one or more graphene layers are embedded in the base material adjacent to the disc rim, while in some embodiments, one or more graphene layers are uniformly embedded in the base material along an entire length of the disc rim. In some embodiments, the disc comprises one or more blade inserts configured to attach a gas turbine engine blade, and in some embodiments, one or more layers are embedded in the base material adjacent to the front and back surfaces.

Aspects of the present disclosure are also drawn to a method of preparing a disc, the method comprising applying one or more graphene layers to a disc rim and/or bore, and heat pressing one or more graphene layers to prepare an exterior graphene surface of the disc rim and/or bore. In some embodiments, the method further comprises doping the exterior graphene surface of the disc rim and/or bore.

Aspects of the present disclosure are also drawn to a method of preparing a disc, the method comprising applying graphene, such as graphene powder, to a base material of a disc and forming the disc such that one or more layers of graphene are embedded in the base material. In some embodiments, one or more layers of graphene are adjacent to a front surface and a back surface of the disc, adjacent to a bore of the disc, adjacent to a disc rim of the disc, or combinations thereof. In certain embodiments, the method of preparing the disc further comprises applying one or more second graphene layers to an outer surface of the disc and/or bore and heat pressing one or more second graphene layers to prepare an exterior graphene surface of the disc and/or bore.

Aspects of the present disclosure are also drawn to a gas turbine engine comprising a disc defining a disc rim and a bore, the disc comprising a base material; one or more blades disposed along the disc rim of the disc; and a shaft disposed through the bore of the disc, wherein the disc comprises one or more graphene layers. In some embodiments, one or more graphene layers are embedded in the base material, and in some embodiments, one or more of the graphene layers is doped with boron, nitrogen, or combinations thereof.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
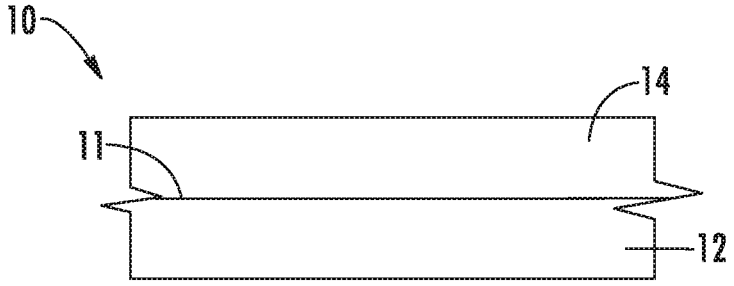
FIG. 1 is a schematic cross sectional view of a disc in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Discs in gas turbine engines are provided herein with one or more graphene layers. In certain embodiments, the discs comprise one or more graphene layers, which may be embedded in the disc and/or disposed as an exterior layer along the surface of the disc and/or the bore of the disc. The one or more graphene layers may be doped with additional components to further improve the disc's performance and lifetime.

Graphene is about 200 times stiffer than steel and is capable of conducting heat about 10 times faster than copper, while still being light weight. Graphene has a melting temperature of about 5000 K (about 4727° C.) and has remarkable properties withstanding flame. The conductivity of graphene is anisotropic, and graphene can be used as an insulating material. Graphene also has better impact resistance than Kevlar.

The high conductivity of graphene and the possibility of adapting to any existing structure given the high melting point of graphene make the incorporation of one or more graphene layers particularly useful for disc rims and bores in high temperature environments. Each layer of graphene is monoatomic and therefore minimally intrusive and can be piled.

One or more graphene layers may be applied to the disc rim and/or bore formed in the center of the disc as well as the front and back faces of the disc and/or may be incorporated into the base material of the disc. The one or more graphene layers may effectively activate the bore and decrease the rim-to-bore gradient in the disc. The one or more graphene layers may thereby provide a reliable and relatively inexpensive solution to increasing the life of the disc. In some embodiments, the one or more graphene layers may be non-reactive thereby also providing protection against corrosion. The one or more graphene layers may also improve the disc's damage tolerance, thereby enabling reduced cooling flow.

Without intending to be bound by theory, one or more graphene layers may be incorporated into or on at least a portion of the disc and/or bore to allow for the conduction of heat from the rim radially inboard. The mechanism that controls low cycle fatigue, that is, conduction through the bore, is changed. Axial conduction speeds up bore activation reducing hoop stresses in acceleration and deceleration (bore compression) as the disc cools down. At the bore, the disc is vented to enhance disc heat transfer and to evacuate the heat conducted by the disc to the surrounding air. The significant increase in life due to the mitigation of rim-to-bore gradients may reduce the need to seek repair of the discs and thereby reduce maintenance costs. The graphene layers may provide an effective means to protect discs without the associated drawbacks of disc coatings seen in conventional coatings.

The graphene layers provided herein may be suitable for use with components of gas turbine engines, for instance, discs in a high pressure turbine or high pressure compressor. The graphene layers may also be used in various other applications, particularly in applications where heat transfer, oxidation protection at high temperatures, and/or weight reduction are concerns. For instance, the presently disclosed graphene layers may be used in applications such as gas turbines, steam turbines, and other heat exchangers. The graphene layers may be used in high pressure compressor (HPC) discs to improve temperature gradients in the disc. For instance, HPC discs may be prepared with one or more graphene layers applied to any side of the disc, embedded in the disc near any side, or combinations thereof.

As used herein, the term "disc(s)" refers to one or more generally circular components having a circumference and a thickness perpendicular to the circumference. The disc(s) may have a bore formed in the center of the disc. In gas turbine engines, discs are generally attached to one or more blades and move around a shaft inserted in the bore of the disc. The bore is generally a circular hole in the center of the disc, but may be any suitable shape to enclose the inserted shaft and engage the shaft, disc, and blades. The disc may be made of metal, such as steel or superalloys (e.g., nickel-based superalloys, cobalt-based superalloys, or iron-based superalloys) or other suitable materials for withstanding high temperatures. As used herein, "disc substrate" or "disc base material" refers generally to the material of which the disc is made, such as the metal or other suitable material.

As used herein, the "outer surface of the disc(s)" generally refers to the outermost surface of one or more discs. The outermost surface is that which would be exposed to the environment without an external layer of graphene. That is, whether the disc comprises one or more layers of materials, the outer surface of the outermost layer will generally be considered the "outer surface of the disc(s)."

As used herein, the "disc rim" generally refers to the outermost surface of the disc that is perpendicular to the circumference of the disc. In certain embodiments, the disc is a circular component with a thickness perpendicular to the face of the disc. The thickness forms the disc rim. In some embodiments, only the disc rim may comprise or be coated with graphene while in other embodiments, the disc rim as well as other areas of the disc, such as the front and back faces of the disc, may comprise one or more graphene layers. In certain embodiments, one or more graphene layers may be embedded in the disc and may be embedded adjacent to the disc rim, the front and back surfaces of the disc, and/or the bore.

As will be described further below, one or more discs may include the presently disclosed graphene layers. In some embodiments, a plurality of discs in a system may include one or more graphene layers. The discs may include one or more graphene layers incorporated into the discs to various degrees without deviating from the intent of the present disclosure.

Graphene is generally configured in monoatomic layers of carbon atoms organized in a hexagonal pattern. In some embodiments, the one or more layers of graphene incorporated into the disc and/or bore may comprise one or more additional components. The additional components may be disposed as a layer adjacent to a graphene layer. In some embodiments, the additional component may be disposed as a component in the graphene matrix. For instance, one or more graphene layers may be doped with an additional component. In some embodiments, the dopant may be distributed uniformly throughout the graphene layer, while in other embodiments, the dopant may be disposed in certain areas of the graphene layer. In such embodiments, the additional component can be a discontinuous phase within the graphene matrix or a continuous phase within the graphene matrix.

As used herein, the "first graphene sheet" and "second graphene sheet" generally refer to successive graphene sections in or on a disc and/or bore. Each "sheet" may include one or more monoatomic layers of graphene, such as about 5, about 10, about 15, or about 20 monoatomic layers of graphene. In some embodiments, both a first graphene sheet and a second graphene sheet may be present. In some embodiments, the first graphene sheet may be positioned immediately adjacent to the outer surface of the disc such that the first graphene sheet is physically touching the disc, and the second graphene sheet may be disposed along the first graphene sheet. In some embodiments, the first graphene sheet and/or additional graphene sheets may be embedded within the base material of the disc, while a second graphene sheet may be also embedded within the base material of the disc and/or disposed along the outer surface of the disc.

Figure 4:
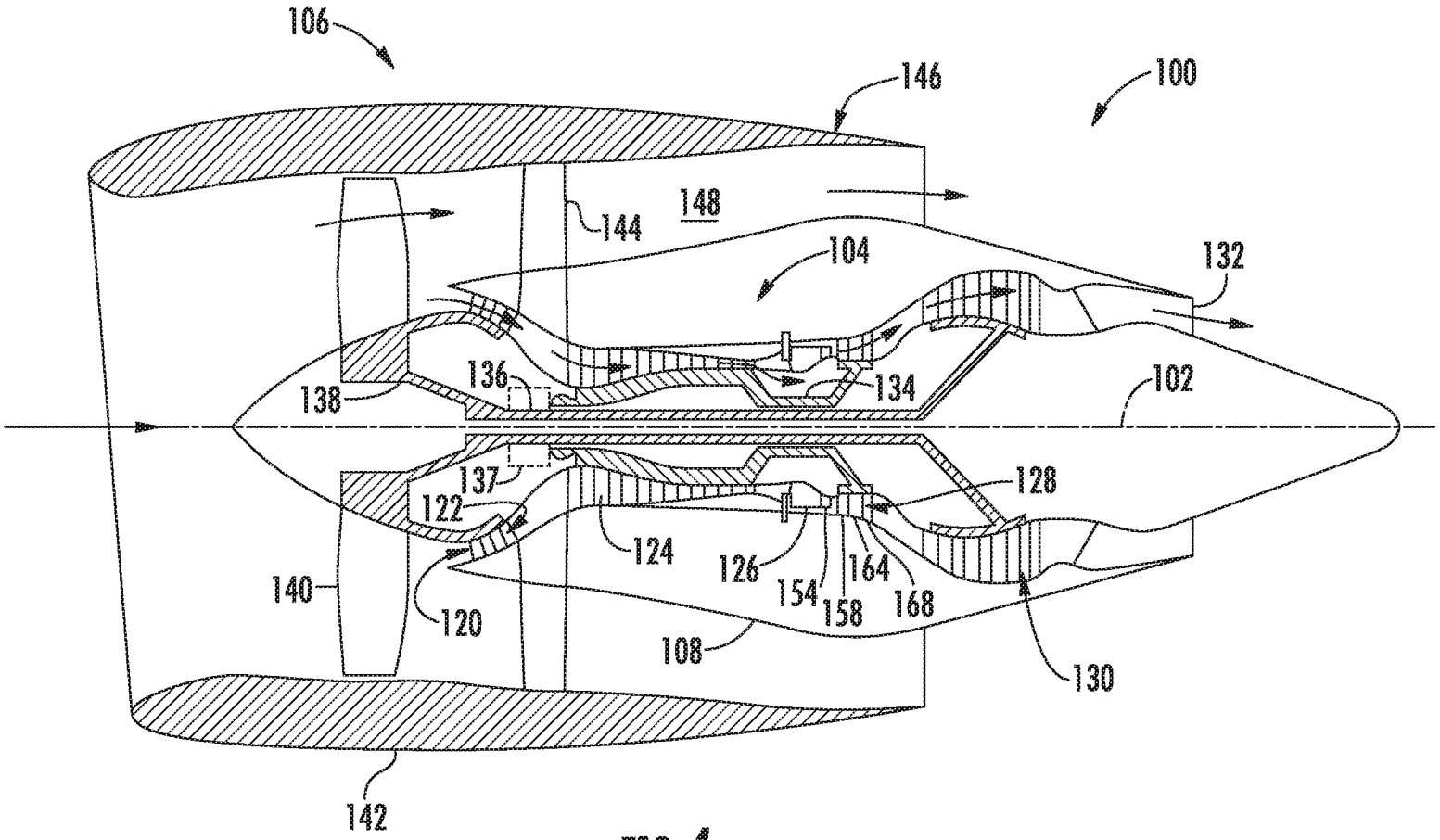
FIG. 4 is a schematic cross sectional view of a gas turbine engine in accordance with one embodiment of the present disclosure.

FIG. 1 is a schematic cross sectional view of a disc 10 of a gas turbine engine (e.g., as shown in FIG. 4) in accordance with one embodiment of the present disclosure. In the embodiment illustrated in FIG. 1, the disc 10 includes a base material 12 having a graphene layer 14 disposed along the outer surface 11 of the base material 12. The graphene layer 14 is illustrated in FIG. 1 as a single layer, however, in some embodiments, one or more, such as a plurality, of graphene layers 14 may be disposed along the outer surface 11 of the base material 12. In certain embodiments, about five or more graphene layers 14 may be piled on the outer surface 11 of the base material 12, such as about 10 or more, about 15 or more, or about 20 or more graphene layers 14 may be piled on the outer surface 11 of the base material 12. For instance, in some embodiments, about 10 to about 25 graphene layers may be piled on the outer surface 11 of the base material 12. In some embodiments, at least 10 monoatomic graphene layers 14 may be piled on the outer surface 11 of the base material 12.

In addition, in some embodiments, one or more bond coats may be used along with the graphene layer 14. For instance, a bond coat may be disposed along the edges of the graphene layer 14 to improve the adhesion of the graphene layer 14 to the base material 12.

The one or more graphene layers 14 may be prepared by heat pressing, such as welding or laser sintering, monoatomic graphene layers to the disc 10. In some embodiments, the one or more graphene layers 14 may be applied uniformly along the disc 10 and may be applied in grooves formed along the surface 11 of the base material 12. The one or more graphene layers 14 may substantially cover the outer surface 11 of the disc 10 or partially cover the outer surface 11 of the disc 10. In certain embodiments, to prevent mechanical harm to the disc, the one or more graphene layers 14 may substantially cover the outer surface 11 of the disc 10. The graphene layers 14 may be formed along the disc rim, front and back surface, and/or bore of the disc.

Figure 2:
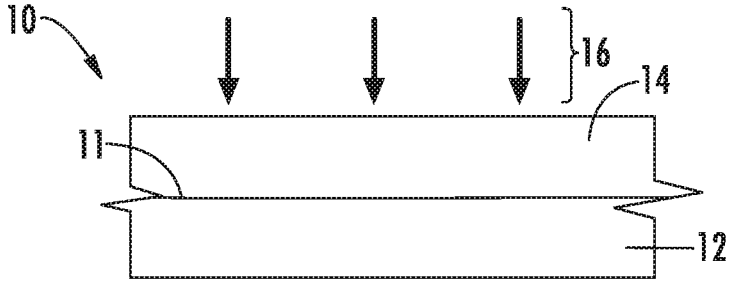
FIG. 2 is a schematic cross sectional view of a disc in accordance with one embodiment of the present disclosure.

FIG. 2 is a schematic cross sectional view of a disc 10 of a gas turbine engine (e.g., as shown in FIG. 4) in accordance with one embodiment of the present disclosure. In the embodiment illustrated in FIG. 2, the disc 10 includes a base material 12 having a graphene layer 14 disposed along the outer surface 11 of the base material 12. The graphene layer 14 is doped with a suitable dopant 16. The dopant 16 may be boron, nitrogen, other elements which enhance heat transfer, or combinations thereof. In some embodiments, the dopant 16 may be distributed uniformly throughout the graphene layer 14, while in other embodiments, the dopant 16 may be disposed in certain areas of the graphene layer 14. The doped graphene layers 14 may be formed along the disc rim, front and back surface, and/or bore of the disc.

The graphene layer 14 is illustrated in FIG. 1 as a single layer, however, in some embodiments, one or more, such as a plurality, of graphene layers 14 may be disposed along the outer surface 11 of the base material 12 and one or more graphene layers 14 may individually, or collectively, be doped with a suitable dopant 16. For instance, in some embodiments, about 10 to about 25 graphene layers 14 may be disposed along the outer surface 11 of the base material 12. In addition, in some embodiments, one or more bond coats may be used along with the graphene layer 14.

Figure 3:
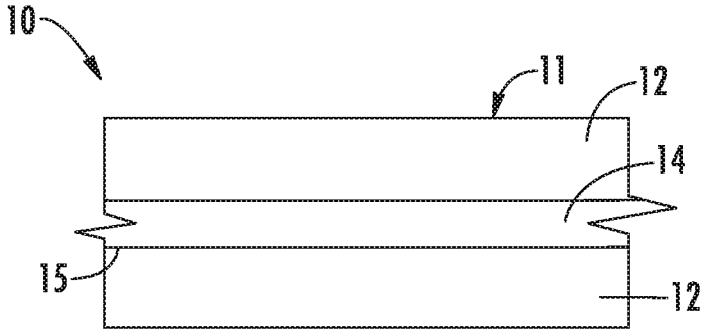
FIG. 3 is a schematic cross sectional view of a disc in accordance with one embodiment of the present disclosure.

FIG. 3 is a schematic cross sectional view of a disc 10 of a gas turbine engine (e.g., as shown in FIG. 4) in accordance with one embodiment of the present disclosure. In the embodiment illustrated in FIG. 3, the disc 10 includes a base material 12 having a graphene layer 14 embedded in the base material 12. That is, the graphene layer 14 is disposed along an internal surface 15 of the disc 10 beneath the outer surface 11 of the disc 10.

A single graphene layer 14 is illustrated in FIG. 3, however, in some embodiments, one or more, such as a plurality, of graphene layers 14 may be embedded in the base material 12. In certain embodiments, five or more graphene layers 14 may be embedded in the base material 12, such as 10 or more, 15 or more, or 20 or more graphene layers 14 may be embedded in the base material 12. For instance, in some embodiments, about 10 to about 25 graphene layers 14 may be embedded in the base material 12. In some embodiments, at least 10 monoatomic graphene layers 14 are embedded in the base material 12.

In some embodiments, a graphene layer 14 may also be disposed along the outer surface 11 of the base material 12 and/or one or more graphene layers 14 may individually, or collectively, be doped with a suitable dopant 16. In addition, in some embodiments, one or more bond coats may be used along with the graphene layer 14.

The embedded graphene layer 14 may be formed by applying one or more layers of graphene to the disc as a powder prior to forging and then forging the disc such that the graphene layers are formed internally in the disc. The graphene layers 14 may be embedded in the base material 12 of the disc adjacent to the disc rim, front and back surface, and/or bore of the disc.

FIG. 4 is a schematic cross-sectional view of a gas turbine engine in accordance with one embodiment of the present disclosure. Although further described below generally with reference to a turbofan engine 100, the present disclosure is also applicable to turbomachinery in general, including turbojet, turboprop and turboshaft gas turbine engines, including industrial and marine gas turbine engines and auxiliary power units.

As shown in FIG. 4, the turbofan 100 has a longitudinal or axial centerline axis 102 that extends therethrough for reference purposes. In general, the turbofan 100 may include a core turbine or gas turbine engine 104 disposed downstream from a fan section 106.

The gas turbine engine 104 may generally include a substantially tubular outer casing 108 that defines an annular inlet 120. The outer casing 108 may be formed from multiple casings. The outer casing 108 encases, in serial flow relationship, a compressor section having a booster or low pressure (LP) compressor 122, a high pressure (HP) compressor 124, a combustion section 126, a turbine section including a high pressure (HP) turbine 128, a low pressure (LP) turbine 130, and a jet exhaust nozzle section 132. A high pressure (HP) shaft or spool 134 drivingly connects the HP turbine 128 to the HP compressor 124. A low pressure (LP) shaft or spool 136 drivingly connects the LP turbine 130 to the LP compressor 122. The (LP) spool 136 may also be connected to a fan spool or shaft 138 of the fan section 106. In particular embodiments, the (LP) spool 136 may be connected directly to the fan spool 138 such as in a direct-drive configuration. In alternative configurations, the (LP) spool 136 may be connected to the fan spool 138 via a speed reduction device 137 such as a reduction gear gearbox in an indirect-drive or geared-drive configuration. Such speed reduction devices may be included between any suitable shafts/spools within engine 100 as desired or required.

As shown in FIG. 4, the fan section 106 includes a plurality of fan blades 140 that are coupled to and that extend radially outwardly from the fan spool 138. An annular fan casing or nacelle 142 circumferentially surrounds the fan section 106 and/or at least a portion of the gas turbine engine 104. It should be appreciated by those of ordinary skill in the art that the nacelle 142 may be configured to be supported relative to the gas turbine engine 104 by a plurality of circumferentially-spaced outlet guide vanes 144. Moreover, a downstream section 146 of the nacelle 142 (downstream of the guide vanes 144) may extend over an outer portion.

While not pictured in FIG. 4, the high pressure shaft 134 is joined to discs, which are attached to blades in the HP turbine 128. The rotation of the blades in the HP turbine 128, powered by the combustion of the compressed gas, powers the upstream HP compressor 124. In certain embodiments, the discs comprise one or more graphene layers 14. For instance, in some embodiments, one or more discs may be at least partially coated with one or more graphene layers 14 and/or include one or more graphene layers 14 embedded in the disc. One or more of the graphene layers 14 may be doped with a suitable dopant.

Figure 5A:
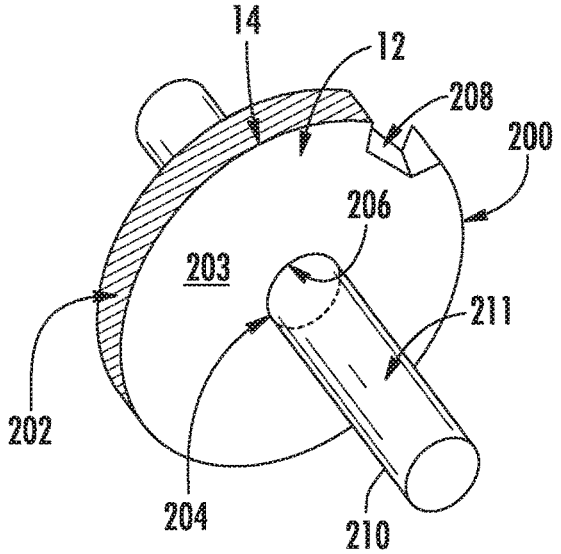
FIGS. 5*a*-5*c* are schematic views of a high pressure turbine disc in accordance with embodiments of the present disclosure.
Figure 5B:
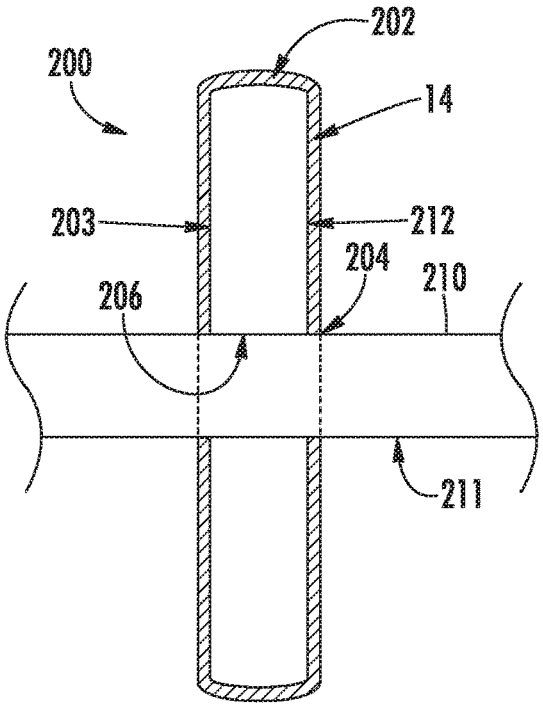
Figure 5C:
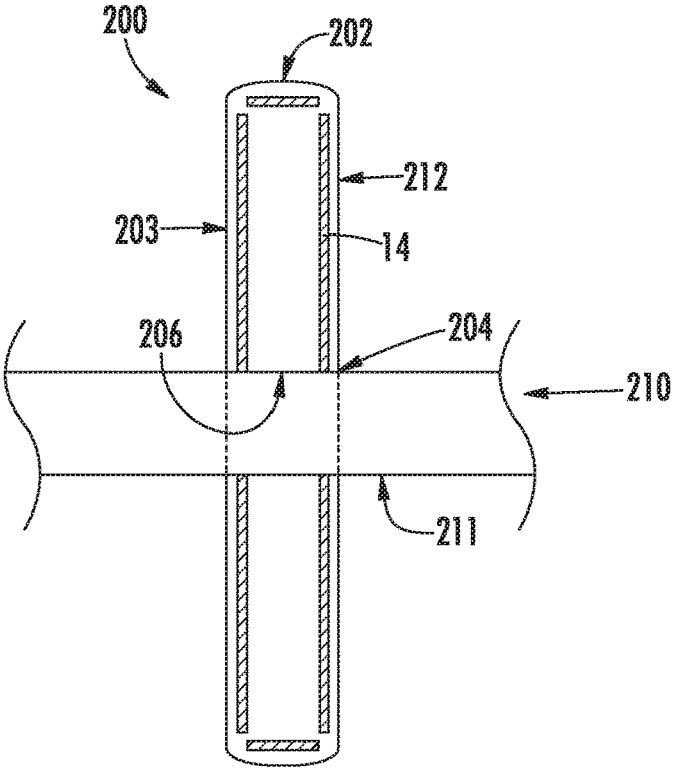

FIGS. 5*a*-5*c* are schematic views of a high pressure turbine disc in accordance with embodiments of the present disclosure. FIGS. 5*a*-5*c* illustrate discs 200 comprising a disc rim 202 and a front surface 203 and a back surface 212 (a back surface is not illustrated in FIG. 5*a*). FIGS. 5*a*-5*c* also illustrate a bore 204 comprising a bore surface 206 and a shaft 210 with a shaft surface 211 inserted into the bore 204. Also illustrated in FIG. 5*a* is a blade insert 208 for blade attachment. Only one blade insert 208 is illustrated in FIG. 5*a*, however, more than one blade insert 208 is typically seen on discs 200. The blade inserts 208 are spaced around the disc rim 202 of the disc 200.

In the embodiment illustrated in FIG. 5*a*, the disc rim 202 is coated with one or more graphene layers 14. The one or more of the graphene layers 14 may be doped with a suitable dopant. In the embodiment illustrated in FIG. 5*b*, the front surface 203 and back surface 212 as well as the disc rim 202 are coated with one or more graphene layers 14, which may be doped with a suitable dopant. In some embodiments, the graphene layers 14 may be disposed along the bore surface 206, the shaft surface 211, and/or the blade insert 208. In the embodiment illustrated in FIG. 5*c*, one or more graphene layers 14 are embedded in the disc 200. In some embodiments, additional graphene layers 14 are embedded in the disc 200 and may be embedded throughout the disc 200. In some embodiments, one or more graphene layers 14 may be embedded adjacent to the disc rim 202 and/or adjacent to the bore 204.

The graphene layers 14 may substantially cover the respective surface and/or may cover one or more portions of the respective surface. In certain embodiments, the graphene layers 14 may be embedded in the disc 200 and/or shaft 210 and may be embedded such that the graphene layers 14 are adjacent to the external surfaces of each component.

Figure 6:
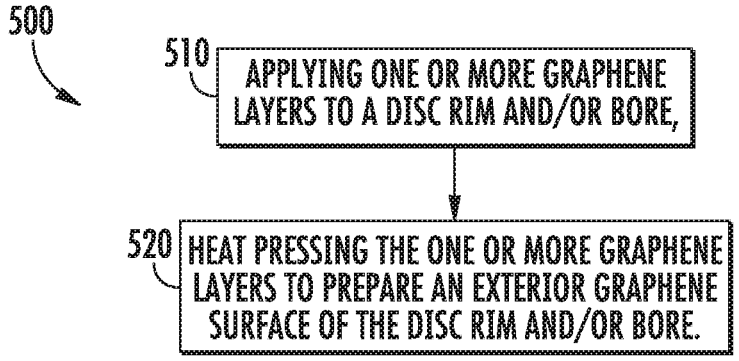
FIG. 6 is a flowchart of a method of preparing one or more graphene layers in accordance with one embodiment of the present disclosure.

FIG. 6 is a flowchart of a method of preparing one or more graphene layers in accordance with one embodiment of the present disclosure. In the embodiment illustrated in FIG. 6, the method of preparing a disc with an exterior graphene surface 500 comprises applying one or more graphene layers to a disc and/or bore 510, and heat pressing the one or more graphene layers to prepare an exterior graphene surface of the disc and/or bore 520. In some embodiments, the method of preparing a disc with an exterior graphene surface 500 may be for preparing a high pressure turbine disc, while in other embodiments, the method of preparing a disc with an exterior graphene surface 500 may be for preparing a high pressure compressor disc. In some embodiments, the method of preparing a disc with an exterior graphene surface 500 further comprises doping the exterior graphene surface, such as doping the exterior graphene surface with boron, nitrogen, or combinations thereof.

Figure 7:
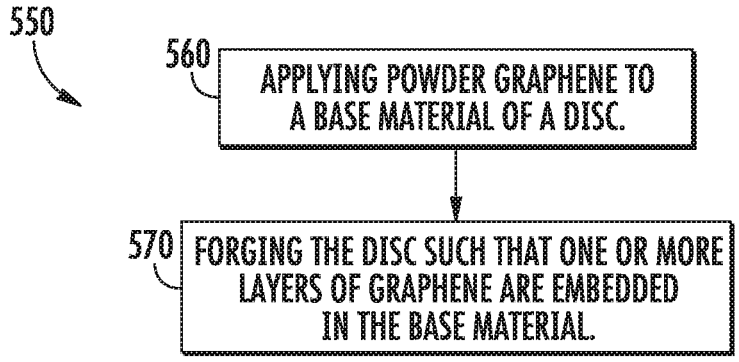
FIG. 7 is a flowchart of a method of preparing one or more graphene layers in accordance with one embodiment of the present disclosure.

FIG. 7 is a flowchart of a method of preparing one or more graphene layers in accordance with one embodiment of the present disclosure. In the embodiment illustrated in FIG. 7, the method of preparing a disc with embedded graphene layers 550 comprises applying powder graphene to a base material of a disc 560, and forging the disc such that one or more layers of graphene are embedded in the base material 570. In some embodiments, the method of preparing a disc with embedded graphene layers 550 may be for preparing a high pressure turbine disc, while in other embodiments, the method of preparing a disc with embedded graphene layers 550 may be for preparing a high pressure compressor disc. In some embodiments, the one or more layers of graphene are adjacent to a bore of the disc. In some embodiments, the one or more layers of graphene are adjacent to a disc rim of the disc.

In certain embodiments, the method of preparing a disc with embedded graphene layers 550 further comprises applying one or more second graphene layers to an outer surface of the disc and/or bore and heat pressing the one or more second graphene layers to prepare an exterior graphene surface of the disc and/or bore.

Other embodiments may comprise three, four, five, or more applications of graphene layers and each layer may comprise the addition of an additional component. The graphene layers may be applied to at least a portion of the outer surface of the disc and the degree of coverage of the disc by each graphene layer may vary and may depend on the composition of the graphene layer.

While the above description focuses on application of the presently disclosed graphene layers to discs for high pressure turbines, the graphene layers may also be used in various other applications, particularly in applications where heat transfer, oxidation protection at high temperatures, and/or weight reduction are concerns. For instance, the graphene layers may be used in applications such as gas turbines, e.g., high pressure turbines (HPT), low pressure turbines (LPT), high pressure compressor (HPC), low pressure compressor (LPC)), steam turbines, and other heat exchangers. The graphene layers are particularly suitable for use where a component experiences temperature gradients, such as those present in gas turbine engines, for example, combustor components, turbine blades, shrouds, nozzles, heat shields, and vanes.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A disc comprising:

a disc defining an outer surface, wherein the disc comprises a base material, and one or more graphene layers embedded in the base material such that the one or more graphene layers is not exposed from an outer surface of the base material, wherein one or more of the graphene layers is doped.

2. The disc according to claim 1, wherein one or more of the graphene layers is doped with boron, nitrogen, or combinations thereof.

3. The disc according to claim 1, wherein at least ten monoatomic graphene layers are embedded in the base material.

4. The disc according to claim 1, wherein the base material comprises a nickel superalloy.

5. The disc according to claim 1, wherein the outer surface comprises a front surface, a back surface, and a disc rim, wherein the disc rim is perpendicular to the front and back surfaces and is defined by the circumference of the disc.

6. The disc according to claim 5, wherein the one or more graphene layers are embedded in the base material adjacent to the disc rim.

7. The disc according to claim 5, wherein the one or more layers are embedded in the base material adjacent to the front and back surfaces.

8. A disc comprising:

a disc defining an outer surface, wherein the disc comprises a base material, and one or more graphene layers embedded in the base material, wherein the outer surface comprises a front surface, a back surface, and a disc rim, wherein the disc rim is perpendicular to the front and back surfaces and is defined by the circumference of the disc, and wherein the one or more graphene layers are uniformly embedded in the base material along an entire length of the disc rim.

9. The disc according to claim 1, wherein the disc comprises one or more blade inserts configured to attach a gas turbine engine blade.

10. A method of preparing a disc, the method comprising:

applying graphene to a base material of a disc, forming the disc such that one or more layers of graphene are embedded in the base material such that the one or more graphene layers is not exposed from an outer surface of the base material, and doping the one or more layers of graphene.

11. The method of preparing a disc according to claim 10, wherein the one or more layers of graphene are adjacent to a front surface and a back surface of the disc.

12. The method of preparing a coated disc according to claim 10, wherein the one or more layers of graphene are adjacent to a disc rim of the disc.

13. The method of preparing a coated disc according to claim 10, further comprising applying one or more second graphene layers to an outer surface of the disc and/or bore and heat pressing the one or more second graphene layers to prepare an exterior graphene surface of the disc and/or bore.

14. A method of preparing a disc, the method comprising:

applying graphene to a base material of a disc, and forming the disc such that one or more layers of graphene are embedded in the base material such that the one or more graphene layers is not exposed from an outer surface of the base material, wherein the one or more layers of graphene are adjacent to a bore of the disc.

15. A gas turbine engine comprising:

a disc defining a disc rim and a bore, the disc comprising a base material;

one or more blades disposed along the disc rim of the disc; and a shaft disposed through the bore of the disc, wherein the disc comprises one or more graphene layers embedded in the base material such that the one or more graphene layers is not exposed from an outer surface of the base material.

16. The gas turbine engine according to claim 15, wherein one or more of the graphene layers is doped with boron, nitrogen, or combinations thereof.

* * * * *